US012163663B2

(12) United States Patent
Boardman

(10) Patent No.: US 12,163,663 B2
(45) Date of Patent: Dec. 10, 2024

(54) FUEL COOLED FUEL-AIR MIXER FOR TURBINE ENGINE COMBUSTION SECTION

(71) Applicant: Raytheon Technologies Corporation, Farmington, CT (US)

(72) Inventor: Gregory Boardman, Owens Cross Roads, AL (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 18/135,594

(22) Filed: Apr. 17, 2023

(65) Prior Publication Data

US 2024/0344702 A1 Oct. 17, 2024

(51) Int. Cl.
*F23R 3/00* (2006.01)
*F23R 3/28* (2006.01)

(52) U.S. Cl.
CPC ..... *F23R 3/286* (2013.01)

(58) Field of Classification Search
CPC ..... F23R 3/286; F23R 3/34; F02C 7/224
See application file for complete search history.

(56) References Cited

U.S. PATENT DOCUMENTS 3,600,890 A * 8/1971 White ..... F02C 7/224 415/114
4,543,781 A 10/1985 Rice
5,675,971 A * 10/1997 Angel ..... F23R 3/286 60/737
11,598,526 B2 3/2023 Clayton
2002/0192615 A1* 12/2002 Moriya ..... F23D 14/02 431/278
2009/0249793 A1 10/2009 Nilsson
2012/0305673 A1 12/2012 Matsuyama
2015/0285504 A1* 10/2015 Melton ..... B23K 26/702 60/737
2017/0298817 A1* 10/2017 Horiuchi ..... F02C 7/16
2017/0356657 A1 12/2017 Roesler
2019/0309950 A1 10/2019 Prociw
2022/0349342 A1 11/2022 Giridharan

FOREIGN PATENT DOCUMENTS

EP 4083508 A1 11/2022

OTHER PUBLICATIONS

EP Search Report for EP Patent Application No. 24157460.7 dated Jul. 11, 2024.
EP Search Report for EP Patent Application No. 24157460.7 dated Oct. 2, 2024.

* cited by examiner

*Primary Examiner* — Katheryn A Malatek
(74) *Attorney, Agent, or Firm* — Getz Balich LLC

(57) ABSTRACT

An assembly is provided for a turbine engine. This assembly includes a combustor, a fuel-air mixer and a mixer guide. The combustor includes a bulkhead. The fuel-air mixer includes an inner passage, a sidewall and a fuel circuit. The inner passage extends axially along an axis within the fuel-air mixer. The sidewall extends circumferentially around and axially along the inner passage. The fuel circuit includes a first fuel passage and a first fuel nozzle outlet fluidly coupled with the first fuel passage. The first fuel passage is embedded within the sidewall and extends along the inner passage. The fuel circuit is configured to direct fuel into the inner passage through the first fuel nozzle outlet. The mixer guide couples the fuel-air mixer to the bulkhead. The mixer guide is configured to slide axially along the fuel-air mixer.

19 Claims, 8 Drawing Sheets

FUEL COOLED FUEL-AIR MIXER FOR TURBINE ENGINE COMBUSTION SECTION

This invention was made with Government support under Contract DE-AR0001561 awarded by the United States Department of Energy, Office of ARPA-E. The Government has certain rights in this invention.

BACKGROUND OF THE DISCLOSURE

1. Technical Field

This disclosure relates generally to a turbine engine and, more particularly, to a fuel-air mixer for the turbine engine.

2. Background Information

As government emissions standards tighten, interest in alternative fuels for gas turbine engines continues to grow. There is interest, for example, in fueling a gas turbine engine with hydrogen ($H_2$) fuel rather than a traditional hydrocarbon fuel such as kerosine to reduce greenhouse emissions. While known hydrogen combustion systems have various advantages, there is still room in the art for improvement.

SUMMARY OF THE DISCLOSURE

According to an aspect of the present disclosure, an assembly is provided for a turbine engine. This assembly includes a combustor, a fuel-air mixer and a mixer guide. The combustor includes a bulkhead. The fuel-air mixer includes an inner passage, a sidewall and a fuel circuit. The inner passage extends axially along an axis within the fuel-air mixer. The sidewall extends circumferentially around and axially along the inner passage. The fuel circuit includes a first fuel passage and a first fuel nozzle outlet fluidly coupled with the first fuel passage. The first fuel passage is embedded within the sidewall and extends along the inner passage. The fuel circuit is configured to direct fuel into the inner passage through the first fuel nozzle outlet. The mixer guide couples the fuel-air mixer to the bulkhead. The mixer guide is configured to slide axially along the fuel-air mixer.

According to another aspect of the present disclosure, another assembly is provided for a turbine engine. This assembly includes a fuel-air mixer and a vane structure. The fuel-air mixer includes an inner passage, a sidewall and a mixer fuel circuit. The inner passage extends axially along an axis within the fuel-air mixer. The sidewall extends circumferentially around and axially along the inner passage. The mixer fuel circuit includes a mixer fuel passage and a first fuel nozzle outlet fluidly coupled with the mixer fuel passage. The mixer fuel passage is embedded within the sidewall and extends along the inner passage. The mixer fuel circuit is configured to direct fuel into the inner passage through the first fuel nozzle outlet. The vane structure includes a stator vane and a vane fuel circuit. The vane fuel circuit includes a second fuel passage. The second fuel passage extends within the stator vane and fluidly upstream of the mixer fuel circuit.

According to still another aspect of the present disclosure, another assembly is provided for a turbine engine. This assembly includes a fuel-air mixer. The fuel-air mixer includes an inner passage, a sidewall, a fuel circuit and an air swirler. The inner passage extends axially along an axis within the fuel-air mixer. The sidewall extends circumferentially around and axially along the inner passage. The fuel circuit includes a first fuel passage and a first fuel nozzle outlet fluidly coupled with the first fuel passage. The first fuel passage is embedded within the sidewall and extends along the inner passage. The fuel circuit is configured to direct fuel into the inner passage through the first fuel nozzle outlet. The air swirler is arranged at an upstream end of the fuel-air mixer. The air swirler is configured to direct swirled air into the inner passage for mixing with the fuel within the inner passage.

The mixer guide may be configured to radially move relative to the bulkhead.

The first fuel passage may extend: circumferentially about the inner passage within the sidewall; and/or axially along the inner passage within the sidewall.

The fuel-air mixer may extend axially along the axis to an end of the fuel-air mixer. The first fuel nozzle outlet may be arranged at the end of the fuel-air mixer.

The first fuel nozzle outlet may be one of a plurality of first fuel nozzle outlets. The first fuel nozzle outlets may be arranged at the end of the fuel-air mixer in an array about the axis.

The first fuel passage may be upstream of the first fuel nozzle outlet along the fuel circuit.

The first fuel passage may be downstream of the first fuel nozzle outlet along the fuel circuit.

The fuel circuit may also include a second fuel passage. The second fuel passage may be embedded within the sidewall. The second fuel passage may extend axially along the first fuel passage. The second fuel passage may be fluidly between the first fuel passage and the first fuel nozzle outlet along the fuel circuit.

The second fuel passage may be circumferentially aligned with the first fuel passage about the axis.

The first fuel passage may be disposed radially outboard of the second fuel passage within the sidewall.

The inner passage may include an upstream passage segment and a downstream passage segment that meets the upstream passage segment at an intersection. The upstream passage segment may have a first lateral width at the intersection. The downstream passage segment may have a second lateral width at the intersection that is larger than the first lateral width.

The first fuel nozzle outlet may be arranged at the intersection.

The first fuel nozzle outlet may be one of a plurality of first fuel nozzle outlets. The first fuel nozzle outlets may be arranged at the intersection in an array about the axis.

The fuel circuit may be configured to direct the fuel into the upstream passage segment through the first fuel nozzle outlet.

The fuel circuit may be configured to direct the fuel into the downstream passage segment through the first fuel nozzle outlet.

The fuel-air mixer may also include an air swirler. The air swirler may be configured to direct swirled air into the inner passage for mixing with the fuel.

The air swirler may be configured as an axial air swirler.

The fuel-air mixer may extend axially along the axis between an upstream end and a downstream end. The air swirler may be arranged at the upstream end.

The fuel-air mixer may also include a plurality of quench apertures arranged in an array about the axis. Each of the quench apertures may extend radially through the sidewall to the inner passage.

The quench apertures may be arranged axially between the first fuel nozzle outlet and a downstream end of the fuel-air mixer.

The assembly may also include a vane structure at a downstream end of the combustor. The vane structure may include a stator vane and a vane fuel circuit. The vane fuel circuit may include a second fuel passage. The second fuel passage may extend within the stator vane and fluidly upstream of the first fuel passage.

The assembly may also include a hydrogen fuel source upstream of and configured to provide the fuel to the fuel circuit. The fuel may be or otherwise include hydrogen fuel.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
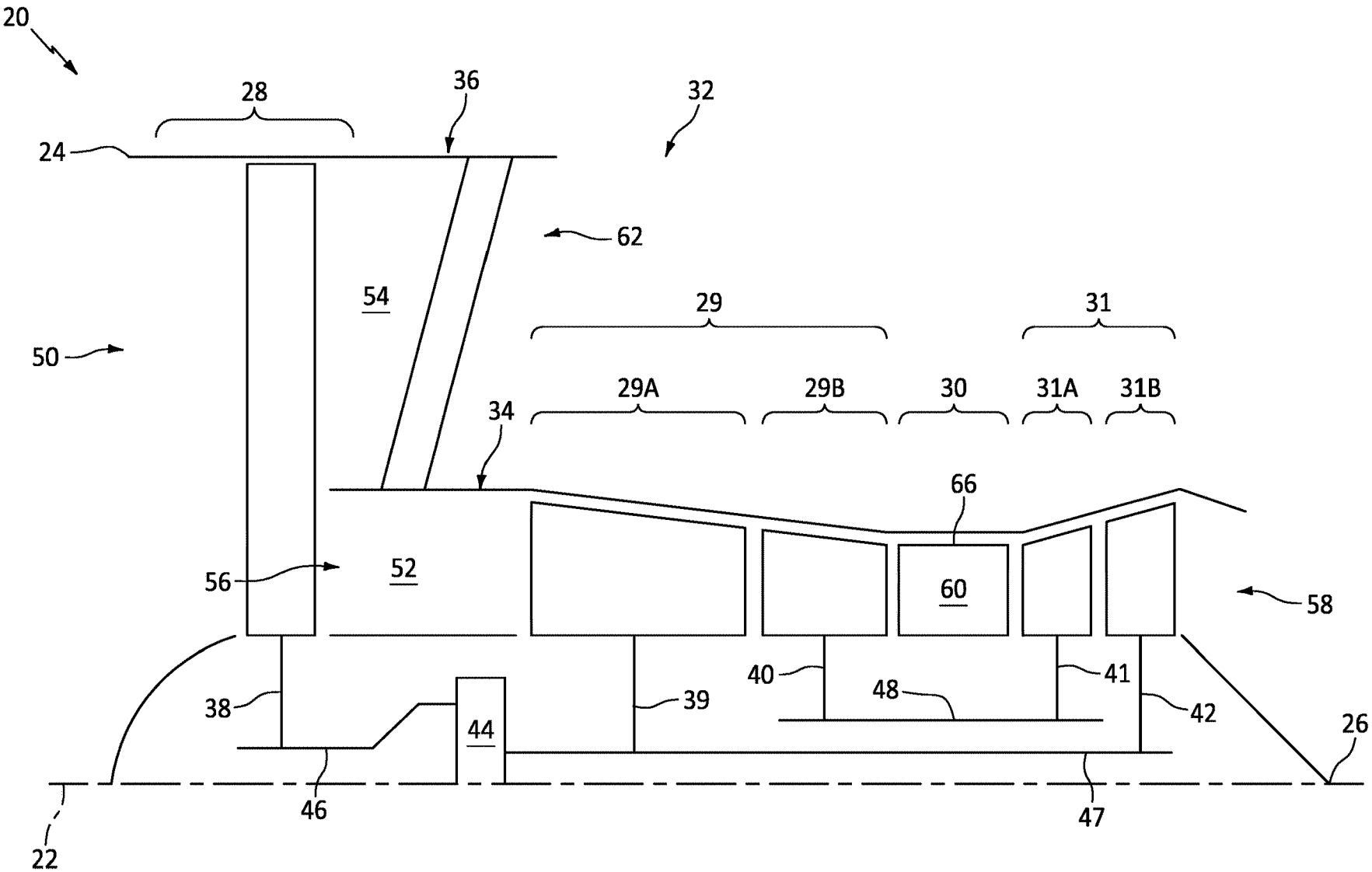
FIG. 1 is a partial schematic illustration of a gas turbine engine.

FIG. 1 is a side sectional illustration of a gas turbine engine 20 for an aircraft propulsion system. This turbine engine 20 extends axially along an axial centerline 22 between a forward, upstream end 24 and an aft, downstream end 26. The turbine engine 20 includes a fan section 28, a compressor section 29, a combustor section 30 and a turbine section 31. The compressor section 29 of FIG. 1 includes a low pressure compressor (LPC) section 29A and a high pressure compressor (HPC) section 29B. The turbine section 31 of FIG. 1 includes a high pressure turbine (HPT) section 31A and a low pressure turbine (LPT) section 31B.

The engine sections 28-31B of FIG. 1 are arranged sequentially along the axial centerline 22 within an engine housing 32. This engine housing 32 includes an inner case 34 (e.g., a core case) and an outer case 36 (e.g., a fan case). The inner case 34 may house one or more of the engine sections 29A-31B; e.g., a core of the turbine engine 20. The outer case 36 may house at least the fan section 28.

Each of the engine sections 28, 29A, 29B, 31A and 31B includes a respective bladed rotor 38-42. Each of these bladed rotors 38-42 includes a plurality of rotor blades arranged circumferentially around and connected to one or more respective rotor disks and/or hubs. The rotor blades, for example, may be formed integral with or mechanically fastened, welded, brazed, adhered and/or otherwise attached to the respective rotor disk(s) and/or the respective hub(s).

The fan rotor 38 is connected to a geartrain 44, for example, through a fan shaft 46. The geartrain 44 and the LPC rotor 39 are connected to and driven by the LPT rotor 42 through a low speed shaft 47. The HPC rotor 40 is connected to and driven by the HPT rotor 41 through a high speed shaft 48. The engine shafts 46-48 are rotatably supported by a plurality of bearings; e.g., rolling element and/or thrust bearings. Each of these bearings is connected to the engine housing 32 by at least one stationary structure such as, for example, an annular support strut.

During engine operation, air enters the turbine engine 20 through an airflow inlet 50 into the turbine engine 20. This air is directed through the fan section 28 and into a core flowpath 52 and a bypass flowpath 54. The core flowpath 52 extends sequentially through the engine sections 29A-31B (e.g., the engine core) from an inlet 56 into the core flowpath 52 to an exhaust 58 from the core flowpath 52. The air within the core flowpath 52 may be referred to as "core air". The bypass flowpath 54 extends through a bypass duct, and bypasses the engine core. The air within the bypass flowpath 54 may be referred to as "bypass air".

The core air is compressed by the LPC rotor 39 and the HPC rotor 40 and directed into a combustion zone 60 within the combustor section 30. Fuel is injected into the combustion zone 60 and mixed with the compressed core air to provide a fuel-air mixture. This fuel-air mixture is ignited and combustion products thereof flow through and sequentially cause the HPT rotor 41 and the LPT rotor 42 to rotate before being directed out of the turbine engine 20 through the core exhaust 58. The rotation of the HPT rotor 41 and the LPT rotor 42 respectively drive rotation of the HPC rotor 40 and the LPC rotor 39 and, thus, compression of the air received from the core inlet 56. The rotation of the LPT rotor 42 also drives rotation of the fan rotor 38, which propels the bypass air through the bypass flowpath 54 and out of the turbine engine 20 through an exhaust 62 from the bypass flowpath 54. The propulsion of the bypass air may account for a majority of thrust generated by the turbine engine 20.

Figure 2:
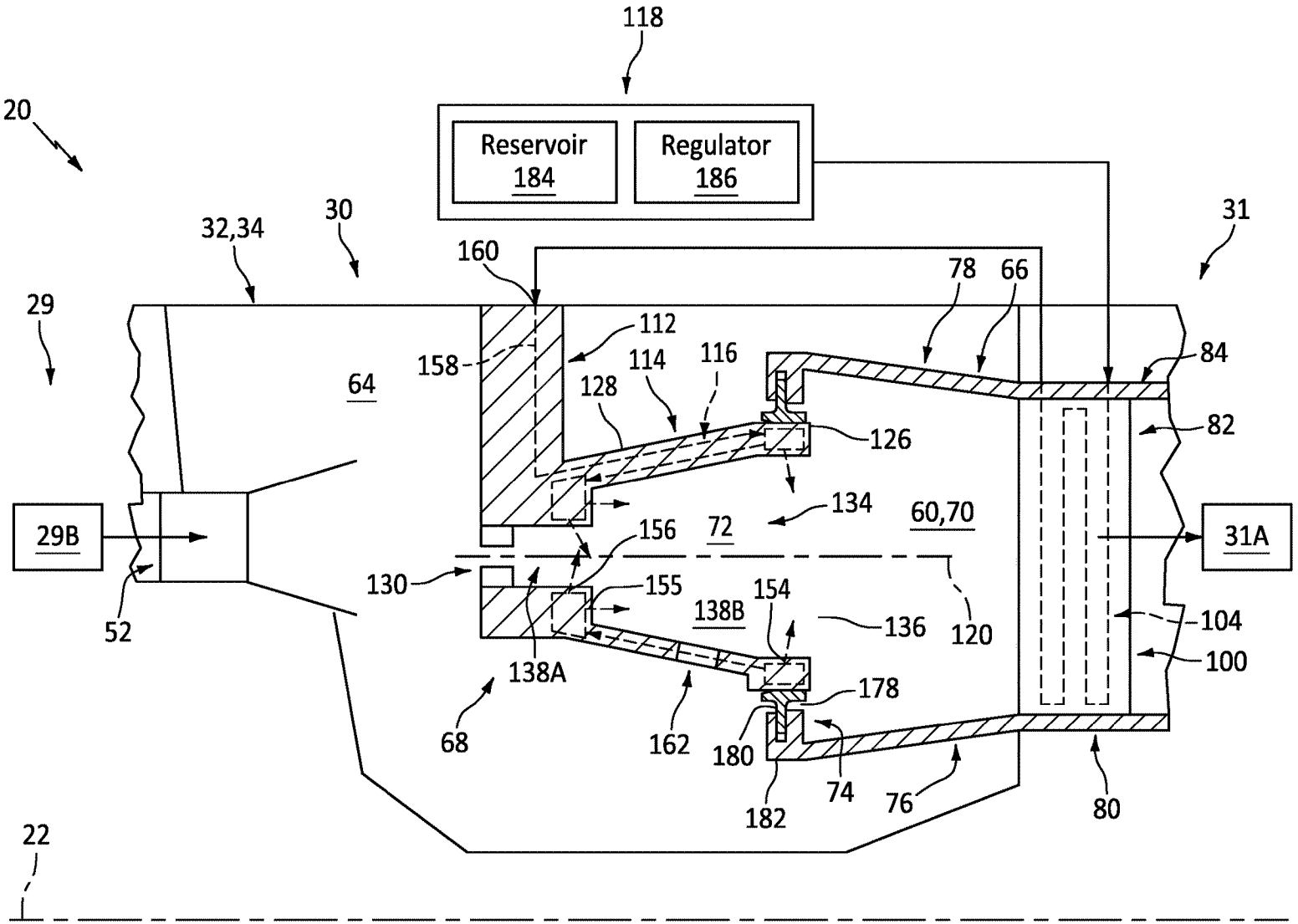
FIG. 2 is a partial schematic illustration of a combustor section between a compressor section and a turbine section.

FIG. 2 illustrates a portion of the combustor section 30 along the core flowpath 52 between the HPC section 29B and the HPT section 31A. This combustor section 30 includes a diffuser plenum 64, a combustor 66 and one or more fuel-air mixers 68 (one visible in FIG. 2). Briefly, the combustor 66 and the fuel-air mixers 68 are disposed within (e.g., surrounded by) the diffuser plenum 64. The diffuser plenum 64 is configured to receive compressed core air from the HPC section 29B for subsequent provision into the combustion zone 60. The combustion zone 60 of FIG. 2 includes a combustion chamber 70 within the combustor 66. This combustion zone 60 may also include an internal volume 72 within the each of the fuel-air mixers 68.

The combustor 66 may be configured as an annular combustor; e.g., an annular floating wall combustor. The combustor 66 of FIGS. 2 and 3, for example, includes an annular combustor bulkhead wall 74 ("bulkhead"), a tubular inner combustor wall 76 ("inner wall") and a tubular outer combustor wall 78 ("outer wall"). The bulkhead 74 of FIG. 2 extends radially between and to the inner wall 76 and the outer wall 78. The bulkhead 74 may be connected (e.g., mechanically fastened or otherwise attached) to the inner wall 76 and/or the outer wall 78. Each combustor wall 76, 78 projects axially along the axial centerline 22 out from the bulkhead 74 towards the HPT section 31A. The inner wall 76 of FIG. 2, for example, projects axially to and may be connected to an inner platform 80 of a downstream stator vane structure 82 (e.g., a turbine inlet nozzle) in the HPT section 31A. The outer wall 78 of FIG. 2 projects axially to and may be connected to an outer platform 84 of the downstream stator vane structure 82. With the arrangement of FIG. 2, the combustion chamber 70 is formed by and extends radially within the combustor 66 between and to the inner wall 76 and the outer wall 78. The combustion chamber 70 is formed by and extends axially (in an upstream direction along the core flowpath 52) into the combustor 66 from the stator vane structure 82 to the bulkhead 74. The combustion chamber 70 also extends within the combustor 66 circumferentially about (e.g., completely around) the axial centerline 22, which may configure the combustion chamber 70 as a full-hoop annulus.

For ease of description, the combustion chamber 70 may be described below as having the above annular configuration. The combustor 66 of the present disclosure, however, is not limited to such an exemplary arrangement. For example, referring to FIG. 4, the combustor 66 may alternatively include/be divided into one or more combustor modules 86; e.g., circumferential sections. Each combustor module 86 may include a circumferential (e.g., arcuate) section of the bulkhead 74, a circumferential (e.g., arcuate) section of the inner wall 76 and a circumferential (e.g., arcuate) section of the outer wall 78. While the wall sections are described above as sections of a common wall, each wall section may alternatively be configured as a standalone component from the other wall sections.

Figure 4:
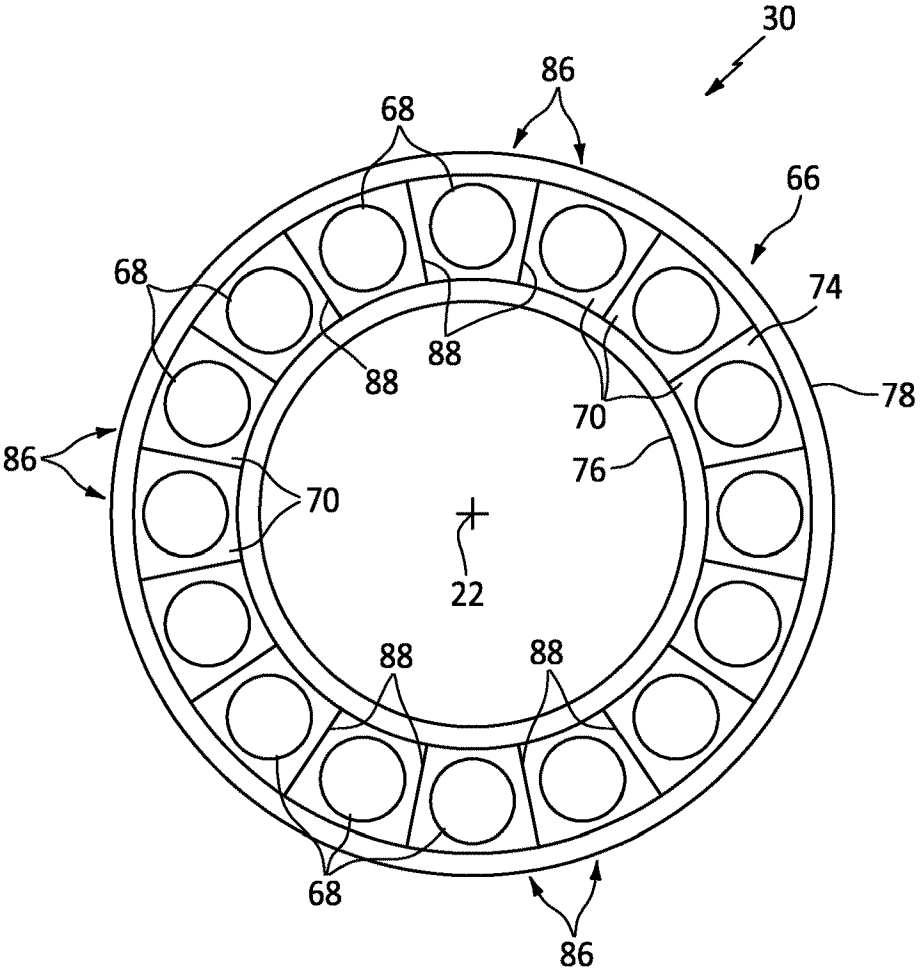
FIG. 4 is a schematic illustration of the combustor section with a modular combustor.

The combustor 66 of FIG. 4 also includes a plurality of dividers 88 arranged circumferentially about the axial centerline 22 in an array. Each of these dividers 88 is configured to circumferentially divide the combustor 66 into the combustor modules 86. Each divider 88 of FIG. 4, in particular, is disposed at a circumferential interface and/or joint between a respective circumferentially neighboring (e.g., adjacent) pair of the combustor modules 86. Each divider 88 may be formed by a single divider wall such that each circumferentially neighboring pair of the combustor modules 86 shares a common divider wall. Alternatively, each divider 88 may be formed by a pair of parallel divider walls such that each circumferentially neighboring pair of the combustor modules 86 has its own divider wall at a respective divider location. With either arrangement, each combustor module 86 is configured with its own arcuate combustion chamber 70. This combustion chamber 70 may extend axially and radially as discussed above. However, instead of extending completely circumferentially around the axial centerline 22, each arcuate combustion chamber 70 extends circumferentially partially about the axial centerline 22 within a respective combustor module 86 between its dividers 88. With such an arrangement, the core flowpath 52 is divided into a plurality of parallel legs within the combustor 66 until reaching, for example, an upstream end or a downstream end of the stator vane structure 82.

Figure 5:
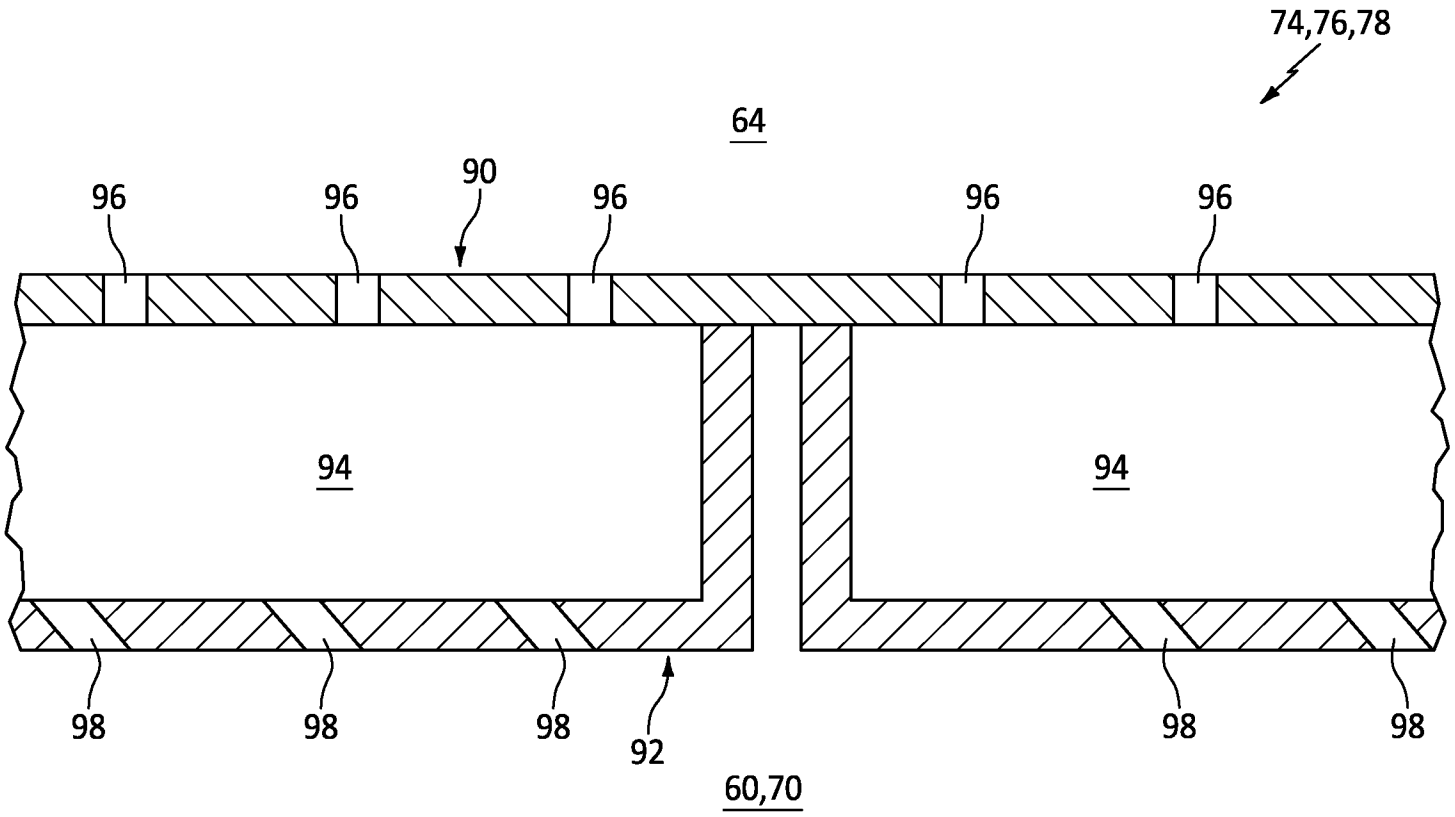
FIG. 5 is a partial sectional illustration of a combustor wall.

Referring to FIG. 5, any one or more or all of the walls 74, 76 and/or 78 may each be configured as a multi-walled structure; e.g., a hollow, dual-walled structure. For example, each wall 74, 76, 78 of FIG. 5 includes a combustor wall shell 90, a combustor wall heat shield 92 (e.g., a liner) and one or more combustor wall cooling cavities 94 (e.g., impingement cavities) formed by and (e.g., radially and/or axially) between the shell 90 and the heat shield 92. Each cooling cavity 94 of FIG. 5 is fluidly coupled with the diffuser plenum 64 through one or more cooling apertures 96 in the shell 90; e.g., impingement apertures. Each cooling cavity 94 of FIG. 5 is fluidly coupled with the combustion chamber 70 through one or more cooling apertures 98 in the heat shield 92; e.g., effusion apertures. Of course, various other multi-walled combustor wall structures are known in the art, and the present disclosure is not limited to any particular ones thereof. Furthermore, it is contemplated any one or more or all of the walls 74, 76 and/or 78 of FIG. 2 may each alternatively be configured as a single-walled structure. The shell 90 (see FIG. 5) for example, may be omitted and the heat shield 92 may form a single walled liner/wall. However, for ease of description, each wall 74, 76, 78 may each be described below as the hollow, dual-walled structure.

The stator vane structure 82 or FIG. 2 includes the inner platform 80, the outer platform 84 and a plurality of stator vanes 100 (one visible in FIG. 2); e.g., combustor exit vanes/turbine inlet vanes. The stator vanes 100 are arranged circumferentially about the axial centerline 22 in an array; e.g., a circular array. Each of these stator vanes 100 extends radially across the core flowpath 52 between and to the inner platform 80 and the outer platform 84. Each of the stator vanes 100 may also be connected to the inner platform 80 and/or the outer platform 84. The stator vane structure 82 and its stator vanes 100 are configured to turn and/or otherwise condition the combustion products exiting the combustion zone 60 for interaction with a first stage of the HPT rotor 41 (see FIG. 1).

Figure 6:
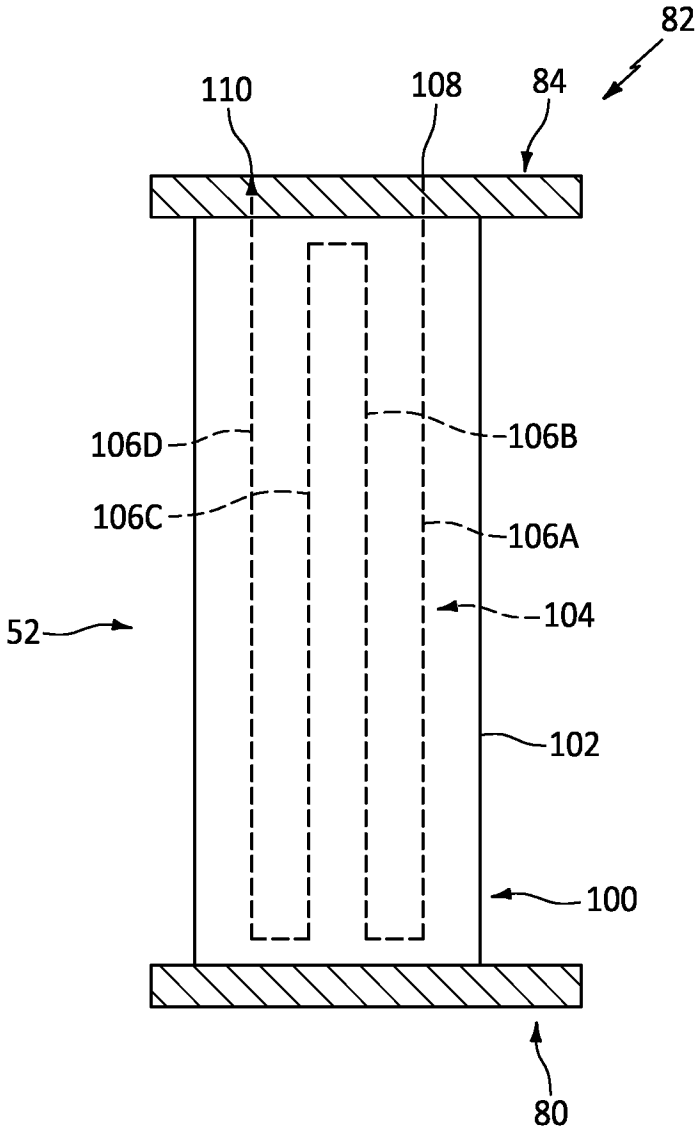
FIG. 6 is a partial sectional schematic illustration of a fuel cooled vane array structure.

Referring to FIG. 6, one or more or all of the stator vanes 100 may each include a stator vane body 102 and a vane fuel circuit 104 (schematically shown); e.g., a vane cooling circuit. The vane fuel circuit 104 may be integrated into (e.g., embedded in material of) the vane body 102. The vane fuel circuit 104 of FIG. 6 includes one or more vane fuel passages 106A-D (generally referred to as "106"). These vane fuel passages 106A-D are serially arranged sequentially between an inlet 108 to the vane fuel circuit 104 and an outlet 110 from the vane fuel circuit 104, where the vane fuel circuit inlet 108 and the vane fuel circuit outlet 110 may be arranged at a radial outer end of the respective stator vane 100; e.g., at the outer platform 84. Each of the vane fuel passages 106 of FIG. 6 extend radially within the vane body 102, for example, along at least seventy percent (70%), eighty percent (80%) or ninety percent (90%) of a radial height of the respective stator vane 100 and its vane body 102 between the inner platform 80 and the outer platform 84. The vane fuel passages 106 may be disposed at discrete locations along a longitudinal length (e.g., camber line length) of the respective stator vane 100 and its vane body 102. With this arrangement, the vane fuel passages 106 may provide the vane fuel circuit 104 with a tortuous (e.g., serpentine) configuration, which extends a length of the vane fuel circuit 104 within the respective stator vane 100 and its vane body 102.

Figure 3:
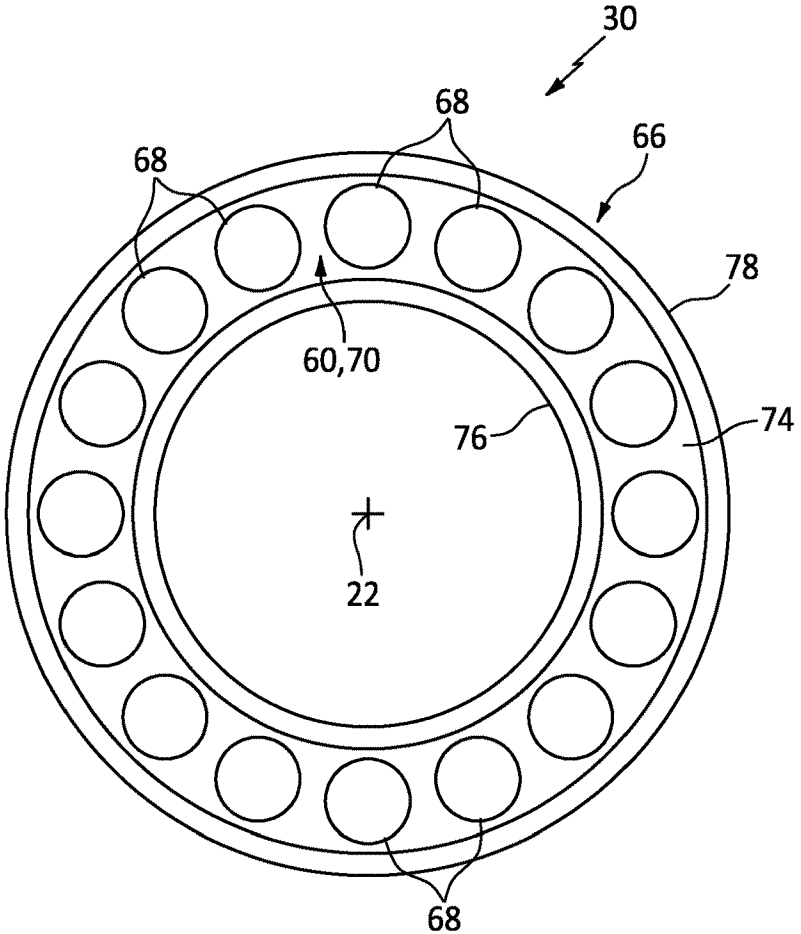
FIG. 3 is a schematic illustration of the combustor section with an annular combustor.

Referring to FIGS. 3 and 4, the fuel-air mixers 68 are arranged circumferentially about the axial centerline 22 in an array; e.g., a circular array. Within this array, the fuel-air mixers 68 may be equally spaced by a common circumferential inter-mixer distance. The present disclosure, however, is not limited to such an exemplary equidistance fuel-air mixer arrangement.

Figure 7:
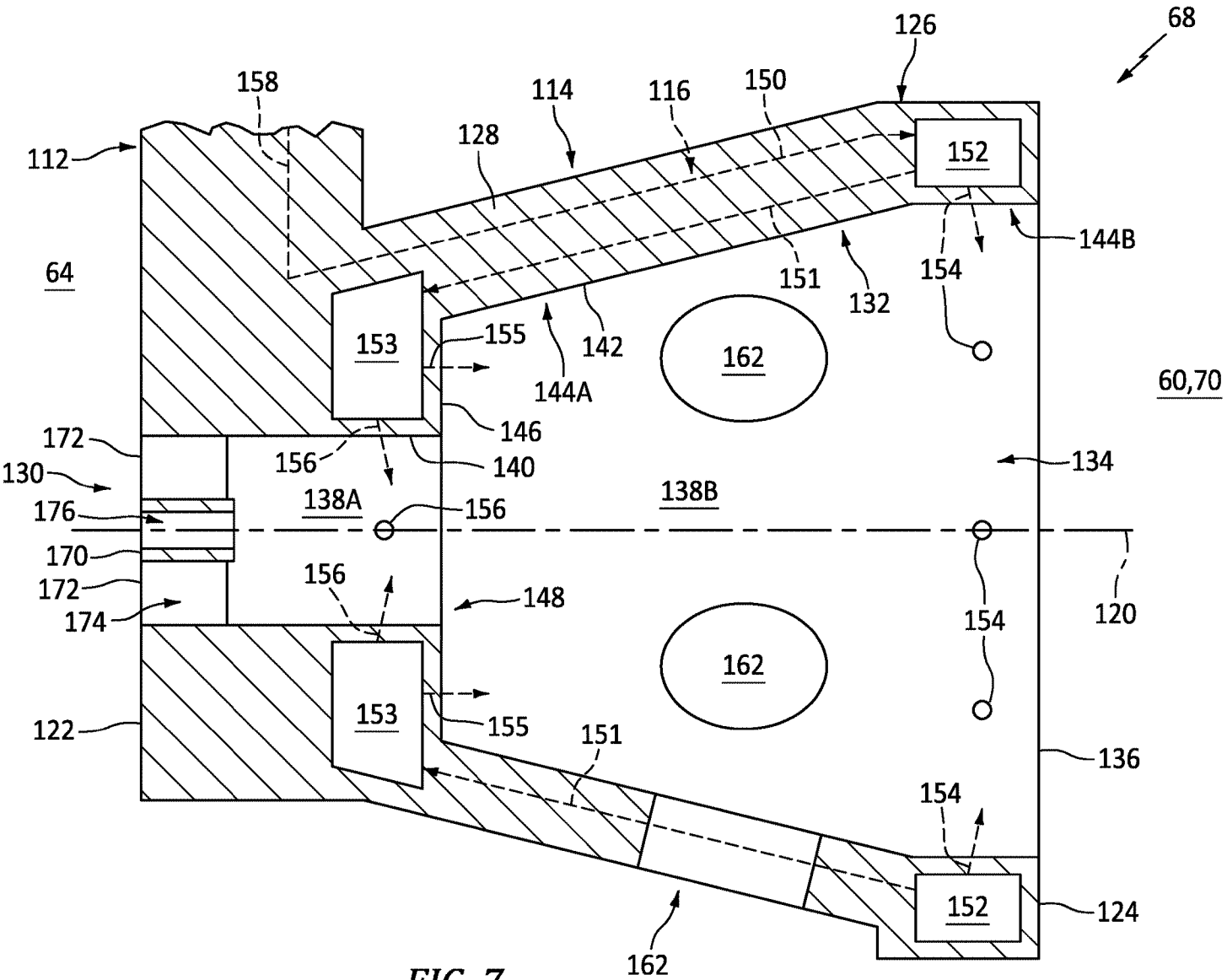
FIG. 7 is a partial sectional schematic illustration of a fuel cooled fuel-air mixer.

Each fuel-air mixer 68 of FIG. 2 includes a mixer stem 112, a tubular mixer body 114 and a mixer fuel circuit 116 (schematically shown). The mixer stem 112 is configured to support and route fuel received from a fuel source 118 (e.g., through the vane fuel circuit(s) 104) to the mixer body 114. Referring to FIG. 7, the mixer body 114 is connected to and may be cantilevered from the mixer stem 112. The mixer body 114 of FIG. 7 extends axially along a centerline axis 120 of the mixer body 114 from an upstream end 122 of the fuel-air mixer 68 and its mixer body 114 to a downstream end 124 of the fuel-air mixer 68 and its mixer body 114. The mixer body 114 projects radially out to an outer side 126 of the mixer body 114. The mixer body 114 of FIG. 7 includes a tubular mixer sidewall 128 and an air swirler 130.

The mixer sidewall 128 of the FIG. 7 extends axially along the axis 120 between and to the mixer upstream end 122 and the mixer downstream end 124, which axis 120 may also be a centerline axis of the mixer sidewall 128. The mixer sidewall 128 extends radially between and to an inner side 132 of the mixer sidewall 128 and the mixer body outer side 126. The mixer sidewall 128 extends circumferentially about (e.g., completely around) the axis 120 thereby forming an inner passage 134 (e.g., a center mixer passage) within the mixer body 114.

The inner passage 134 extends axially along the axis 120 within the mixer body 114, which axis 120 may also be a centerline axis of the inner passage 134. The inner passage 134 of FIG. 7, for example, projects axially through an interior of the mixer sidewall 128 from the mixer upstream end 122 to an outlet orifice 136 from the inner passage 134 at the mixer downstream end 124. Briefly, referring to FIG. 2, this passage outlet orifice 136 fluidly couples the inner passage 134 to the combustion chamber 70. Referring again to FIG. 7, the inner passage 134 may include one or more passage segments 138A and 138B (generally referred to as "138") along the axis 120.

The upstream passage segment 138A extends axially within the mixer body 114 from the mixer upstream end 122 to the downstream passage segment 138B. The upstream passage segment 138A projects radially out from the axis 120 to a tubular inner first surface 140 of the mixer body 114 and its mixer sidewall 128. At least a portion or an entirety of the first surface 140 may have a uniform width (e.g., constant diameter) along the axis 120. The first surface 140 of FIG. 7, for example, is cylindrical. In other embodiments, however, the first surface 140 may alternatively include one or more radially tapering and/or expanding portions with, for example, frustoconical or other geometries.

The downstream passage segment 138B extends axially within the mixer body 114 from the upstream passage segment 138A to the passage outlet orifice 136. The downstream passage segment 138B projects radially out from the axis 120 to a tubular inner second surface 142 of the mixer body 114 and its mixer sidewall 128. An upstream portion 144A of the second surface 142 may have a variable width (e.g., changing diameter) along the axis 120. A downstream portion 144B of the second surface 142 may have uniform width (e.g., constant diameter) along the axis 120. With this arrangement, the downstream passage segment 138B may (e.g., continuously) radially expand (e.g., flare) outward away from the axis 120 as the inner passage 134 and its downstream passage segment 138B extend axially along the axis 120 away from the mixer upstream end 122 and towards (or to) the mixer downstream end 124; e.g., from the upstream passage segment 138A to or about the downstream portion 144B of the second surface 142/the passage outlet orifice 136.

Each of the passage segments 138 may be configured as an inner bore of the mixer sidewall 128. However, the downstream passage segment 138B of FIG. 7 may also be a counterbore to the upstream passage segment 138A. An annular shelf 146, for example, projects radially outward from the first surface 140 to the second surface 142 at an intersection 148 between the passage segments 138A and 138B. This shelf 146 may be perpendicular to the axis 120; however, the present disclosure is not limited thereto.

The mixer sidewall 128 of FIG. 7 is configured with at least a portion of the mixer fuel circuit 116. The mixer fuel circuit 116 of FIG. 7, for example, includes one or more mixer fuel passages 150 and 151, one or more mixer fuel plenums 152 and 153 and one or more fuel nozzle outlets 154-156, where each of these mixer fuel circuit elements 150-156 may be formed in/by the mixer body 114 and its mixer sidewall 128. The mixer fuel circuit 116 of FIG. 7, however, also includes a fuel supply passage 158 configured with the mixer stem 112. This fuel supply passage 158 is formed in/by the mixer stem 112, and the fuel supply passage 158 extends through the mixer stem 112 from an inlet 160 (see FIG. 2) into the mixer fuel circuit 116 to (or towards) the outer fuel passage 150.

Each of the mixer fuel circuit elements 150-153 of FIG. 7 is embedded within the mixer sidewall 128. More particularly, each of the mixer fuel circuit elements 150-153 is disposed/formed within the mixer sidewall 128 between the sidewall inner side 132 and the mixer body outer side 126. The outer fuel passage 150 is radially outboard of the inner fuel passage 151. This outer fuel passage 150 extends within the mixer sidewall 128 (e.g., axially along the inner passage 134, the axis 120 and/or the inner fuel passage 151) from a distal end of the fuel supply passage 158 to the intermediate fuel plenum 152. The intermediate fuel plenum 152 is arranged at the mixer downstream end 124. The inner fuel passage 151 is radially inboard of the outer fuel passage 150. This inner fuel passage 151 extends within the mixer sidewall 128 (e.g., axially along the inner passage 134, the axis 120 and/or the outer fuel passage 150) from the intermediate fuel plenum 152 to the downstream fuel plenum 153. The downstream fuel plenum 153 is arranged at the intersection 148 between the upstream passage segment 138A and the downstream passage segment 138B. The downstream fuel plenum 153 of FIG. 7, for example, is disposed at a corner between the first surface 140 and the shelf 146. With this arrangement, the mixer fuel circuit elements 158, 150, 152, 151 and 153 may be fluidly coupled in series along a length of the mixer fuel circuit 116.

Each of the mixer fuel circuit elements 150-153 may extend circumferentially about (e.g., partially or completely around) the axis 120 within the mixer body 114 and its mixer sidewall 128. The outer fuel passage 150, for example, may extend partially circumferentially along and about the inner fuel passage 151, the downstream fuel plenum 153 as well as the upstream passage segment 138A and the downstream passage segment 138B. The inner fuel passage 151 and the intermediate fuel plenum 152 may each circumscribe (or otherwise extend circumferentially along and about) the downstream passage segment 138B. The downstream fuel plenum 153 may circumscribe (or otherwise extend circumferentially along and about) the upstream passage segment 138A.

The one or more intermediate fuel nozzle outlets 154 are arranged circumferentially about the axis 120 in an array (e.g., a circular array) at or near the mixer downstream end 124. Each of these intermediate fuel nozzle outlets 154 projects radially out from the intermediate fuel plenum 152 (in a radial inward direction) to a respective outlet orifice in the second surface 142. Each of the intermediate fuel nozzle outlets 154 is configured to direct (e.g., inject) the fuel into the inner passage 134 and its downstream passage segment 138B in the radial inward direction towards the axis 120. Here, the fuel is also directed out from each intermediate fuel nozzle outlet 154 (e.g., slightly) in an axial downstream direction; e.g., axially towards the passage outlet orifice 136. However, a radial component of a trajectory of the fuel may be (e.g., significantly) greater than an axial component of the fuel trajectory. The present disclosure, however, is not limited to such an exemplary fuel spray pattern. The fuel trajectory, for example, may alternatively be perpendicular to the axis 120.

The one or more axial fuel nozzle outlets 155 are arranged circumferentially about the axis 120 in an array (e.g., a circular array) at or near the intersection 148. Each of these axial fuel nozzle outlets 155 projects axially out from the downstream fuel plenum 153 (in the axial downstream direction) to a respective outlet orifice in the shelf 146. Each of the axial fuel nozzle outlets 155 is configured to direct (e.g., inject) the fuel into the inner passage 134 and its downstream passage segment 138B in the axial downstream direction towards the passage outlet orifice 136. Here, a trajectory of the fuel directed out of each axial fuel nozzle outlet 155 is parallel to the axis 120. The present disclosure, however, is not limited to such an exemplary fuel spray pattern. The fuel trajectory, for example, may also include a radial component; e.g., radially inwards towards the axis 120, or radially outward away from the axis 120.

The one or more radial fuel nozzle outlets 156 are arranged circumferentially about the axis 120 in an array (e.g., a circular array) at or near the intersection 148. Each of these radial fuel nozzle outlets 156 projects radially out from the downstream fuel plenum 153 (in the radial inward direction) to a respective outlet orifice in the first surface 140. Each of the radial fuel nozzle outlets 156 is configured to direct (e.g., inject) the fuel into the inner passage 134 and its upstream passage segment 138A in the radial inward direction towards the axis 120. Here, the fuel is also directed out from each radial fuel nozzle outlet 156 (e.g., slightly) in the axial downstream direction; e.g., axially towards the passage outlet orifice 136 and/or the downstream passage segment 138B. However, a radial component of a trajectory of the fuel may be (e.g., significantly) greater than an axial component of the fuel trajectory. The present disclosure, however, is not limited to such an exemplary fuel spray pattern. The fuel trajectory, for example, may alternatively be perpendicular to the axis 120.

The mixer body 114 and its mixer sidewall 128 of FIG. 7 may also be configured with one or more quench apertures 162. These quench apertures 162 are arranged circumferentially about the axis 120 in an array; e.g., a circular array. Within the array, the quench apertures 162 may be equally spaced by a common circumferential inter-aperture distance. The present disclosure, however, is not limited to such an exemplary equidistance quench aperture arrangement.

The quench apertures 162 of FIG. 7 are arranged axially along the inner passage 134 and its downstream passage segment 138B, for example axially between and spaced from the intermediate fuel nozzle outlets 154 and the fuel nozzle outlets 155, 156. Each quench aperture 162 extends radially through the mixer sidewall 128 from an inlet orifice into the respective quench aperture 162 to an outlet orifice from the respective quench aperture 162. The inlet orifice is disposed at the mixer body outer side 126. The outlet orifice is disposed at the sidewall inner side 132, for example, in the second surface 142 and towards the mixer downstream end 124 and/or the passage outlet orifice 136.

Figure 8B:
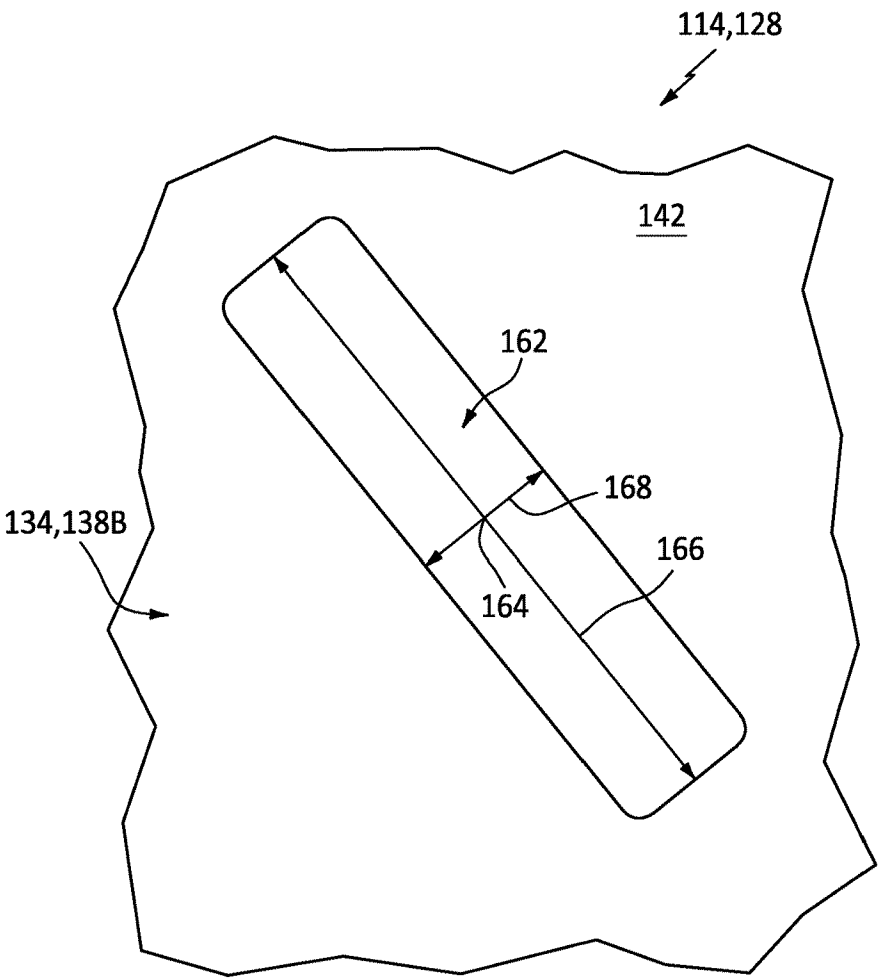
FIGS. 8A and 8B are schematic illustrations of various quench aperture geometries.
Figure 8A:
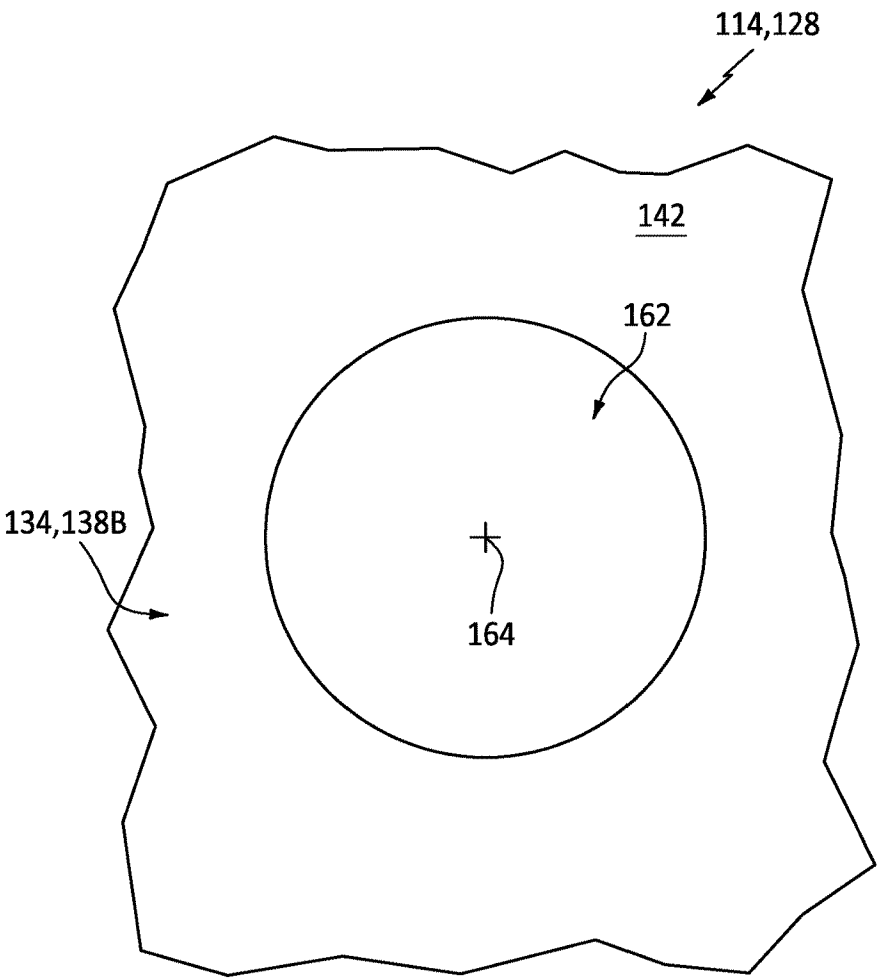

Referring to FIGS. 8A and 8B, each quench aperture 162 has a cross-sectional geometry; e.g., shape and size. The cross-sectional geometry of each quench aperture 162 may be uniform; e.g., the same. Alternatively, the cross-sectional geometry of one or more of the quench apertures 162 may be different (e.g., in shape and/or size) than the cross-sectional geometry of one or more other quench apertures.

In some embodiments, referring to FIG. 8A (see also FIG. 7), one or more or all of the quench apertures 162 may each have a regular cross-sectional geometry (e.g., a non-elongated cross-sectional geometry) when viewed, for example, in a reference plane perpendicular to a centerline 164 of the respective quench aperture 162. Here, a "regular" shape may describe a shape with equal length sides that are symmetrically placed about a center of the shape. The regular cross-sectional geometry, for example, may have a circular shape, a square shape or any other regular curved and/or polygonal shape.

In some embodiments, referring to FIG. 8B, one or more or all of the quench apertures 162 may each have an elongated cross-sectional geometry when viewed, for example, in a reference plane perpendicular to the centerline 164 of the respective quench aperture 162. This elongated cross-sectional geometry may have a major axis dimension 166 that is greater than a minor axis dimension 168. The elongated cross-sectional geometry may have a slot shape, an oval shape, a rectangular shape or any other elongated curved and/or polygonal shape.

Referring to FIG. 7, the air swirler 130 may be arranged at the mixer upstream end 122. The air swirler 130 may be integrated with the mixer body 114, or alternatively attached to the mixer body 114. The air swirler 130 of FIG. 7, for example, includes a (e.g., tubular) swirler guide 170 and one or more swirler vanes 172.

The swirler guide 170 extends circumferentially about (e.g., completely around) the axis 120. The swirler guide 170 extends axially along the axis 120 within the inner passage 134 and its upstream passage segment 138A at the mixer upstream end 122. The swirler guide 170 is spaced radially inward from the first surface 140. With such an arrangement, the swirler guide 170 forms an annular swirler passage 174 with the mixer sidewall 128 and its first surface 140. This swirler passage 174 fluidly couples the diffuser plenum 64 (see also FIG. 2) to the inner passage 134. An inner bore 176 through the swirler guide 170 may form a center inlet into the inner passage 134 from the diffuser plenum 64 (see also FIG. 2).

The swirler vanes 172 are arranged circumferentially about the axis 120 in an array; e.g., a circular array. Each of these swirler vanes 172 is connected to and extends radially between the swirler guide 170 and the mixer sidewall 128. Each of the swirler vanes 172 thereby radially crosses the swirler passage 174. The swirler vanes 172 are arranged to impart swirl onto the compressed core air directed through the swirler passage 174 from the diffuser plenum 64 into the inner passage 134. The swirl may be imparted in a clockwise or counterclockwise direction about the axis 120.

Referring to FIG. 2, each fuel-air mixer 68 is mated with the combustor 66. More particularly, each fuel-air mixer 68 and its mixer body 114 is mated with the bulkhead 74. The mixer body 114 of FIG. 2, for example, projects axially along the axis 120 through (or partially into) an aperture 178 in the bulkhead 74. Each fuel-air mixer 68 and its mixer body 114 may be attached to the combustor 66 and its bulkhead 74 using a (e.g., annular) mixer guide 180; e.g., a mount, a guide plate, etc. This mixer guide 180 circumscribes the mixer body 114 and its mixer sidewall 128. The mixer guide 180 of FIG. 2 radially engages (e.g., contacts) the mixer sidewall 128 at the mixer body outer side 126, and may be configured to move (e.g., translate, slide) axially along the mixer sidewall 128. The mixer guide 180 may also be moveably coupled to the combustor 66 and its bulkhead 74. The mixer guide 180 of FIG. 2, for example, may be retained within a slot of a mount 182 connected to the bulkhead 74 to facilitate radial movement of the mixer guide 180 relative to the bulkhead 74. The present disclosure, however, is not limited to such an exemplary attachment technique.

During operation of the combustor section 30 of FIG. 2, each fuel-air mixer 68 receives the fuel from the fuel source 118 and compressed core air from the diffuser plenum 64. At each fuel-air mixer 68, the fuel nozzle outlets 155 and 156 inject the fuel into the inner passage 134. The air swirler 130 directs the compressed core air into the inner passage 134 and its upstream passage segment 138A to mix with the fuel. This fuel-air mixture flows out of the upstream passage segment 138A into the downstream passage segment 138B. An ignitor (not shown) may ignite the fuel-air mixture within the downstream passage segment 138B; e.g., the mixer internal volume 72 of the combustion zone 60. The quench apertures 162 direct additional compressed core air into the inner passage 134 and its downstream passage segment 138B to quench (e.g., stoichiometrically lean) the combustion products (e.g., the ignited fuel-air mixture) generated by the ignition of the fuel-air mixture. Following this quenching, the fuel nozzle outlets 154 may inject additional fuel into the inner passage 134 and its downstream passage segment 138B to facilitate further combustion. The quenched combustion products then flow out of the passage outlet orifice 136 into the combustion chamber 70 for further combustion. Thus, the combustion process may initiate within the inner passage 134 of the fuel-air mixer 68 and continue (e.g., substantially finish) within the combustion chamber 70 before flowing into the turbine section 31 and its HPT section 31A through the stator vane structure 82.

With the arrangement of FIG. 2, a Rich-Quench-Lean (RQL) combustion process may be shifted upstream into the fuel-air mixer 68. This may facilitate more targeted/tailored quenching of the combustion products, which may be particularly useful with use of alternative fuels such as, but not limited to, hydrogen ($H_2$) gas. By shifting the RQL combustion process further upstream into the fuel-air mixer 68, a time the combustion products are at high temperature may be reduced, which may reduce nitric oxide (NOx) production. Furthermore, by shifting the RQL combustion process further upstream into the fuel-air mixer 68, an overall length of the combustor 66 and its combustion chamber 70 may be reduced. The combustor 66 of FIG. 2, for example, has an axial length that equal to or less than an axial length of the fuel-air mixers 68. Of course, in other embodiments, the combustor length may alternatively be greater than the mixer length. In still other embodiments, the mixer length may be increased such that all of the combustion process occurs within the fuel-air mixers 68 and the combustor 66 may be omitted.

To accommodate the exposure of each fuel-air mixer 68 to the combustion process, the mixer fuel circuit 116 flows the fuel through the mixer sidewall 128 prior to injection into the inner passage 134. The fuel may thereby cool the mixer body 114 and its mixer sidewall 128 prior to injection. In addition to cooling the mixer body 114, this heat transfer process also pre-heats the fuel for injection and combustion. The fuel may be further pre-heated by also flowing the fuel through the vane fuel circuit 104, upstream of the mixer fuel circuit 116. The vane fuel circuit(s) 104, for example, are fluidly coupled between the fuel source 118 and the mixer fuel circuit(s) 116. This heat transfer process also cools the stator vanes 100 as well, which may increase vane structure durability.

The fuel source 118 of FIG. 2 includes a fuel reservoir 184 and/or a fuel flow regulator 186; e.g., a valve and/or a pump. The fuel reservoir 184 is configured to store the fuel before, during and/or after turbine engine operation. The fuel reservoir 184, for example, may be configured as or otherwise include a tank, a cylinder, a pressure vessel, a bladder or any other type of fuel storage container. The fuel flow regulator 186 is configured to direct and/or meter a flow of the fuel from the fuel reservoir 184 to one or more or all of the fuel circuits.

The fuel delivered by the fuel source 118 may be a non-hydrocarbon fuel; e.g., a hydrocarbon free fuel. Examples of the non-hydrocarbon fuel include, but are not limited to, hydrogen fuel (e.g., hydrogen ($H_2$) gas) and ammonia fuel (e.g., ammonia ($NH_3$) gas). The turbine engine 20 of FIG. 1 may thereby be configured as a non-hydrocarbon turbine engine; e.g., a hydrocarbon free turbine engine. The present disclosure, however, is not limited to non-hydrocarbon turbine engines. The fuel delivered by the fuel source 118 of FIG. 2, for example, may alternatively be a hydrocarbon fuel such as, but not limited to, kerosene, jet fuel or sustainable aviation fuel (SAF). The turbine engine 20 of FIG. 1 may thereby be configured as a hydrocarbon turbine engine. Alternatively, the fuel source 118 of FIG. 2 may be configured as a multi-fuel system operable to deliver, individually or in combination, multiple different fuels (e.g., a non-hydrocarbon fuel and a hydrocarbon fuel, etc.) for combustion within the combustion zone 60. The turbine engine 20 of FIG. 1 may thereby be configured as a multi-fuel turbine engine; e.g., a dual-fuel turbine engine. However, for ease of description, the fuel delivered by the fuel source 118 of FIG. 2 may be described as the non-hydrocarbon fuel; e.g., the hydrogen fuel.

Figure 9:
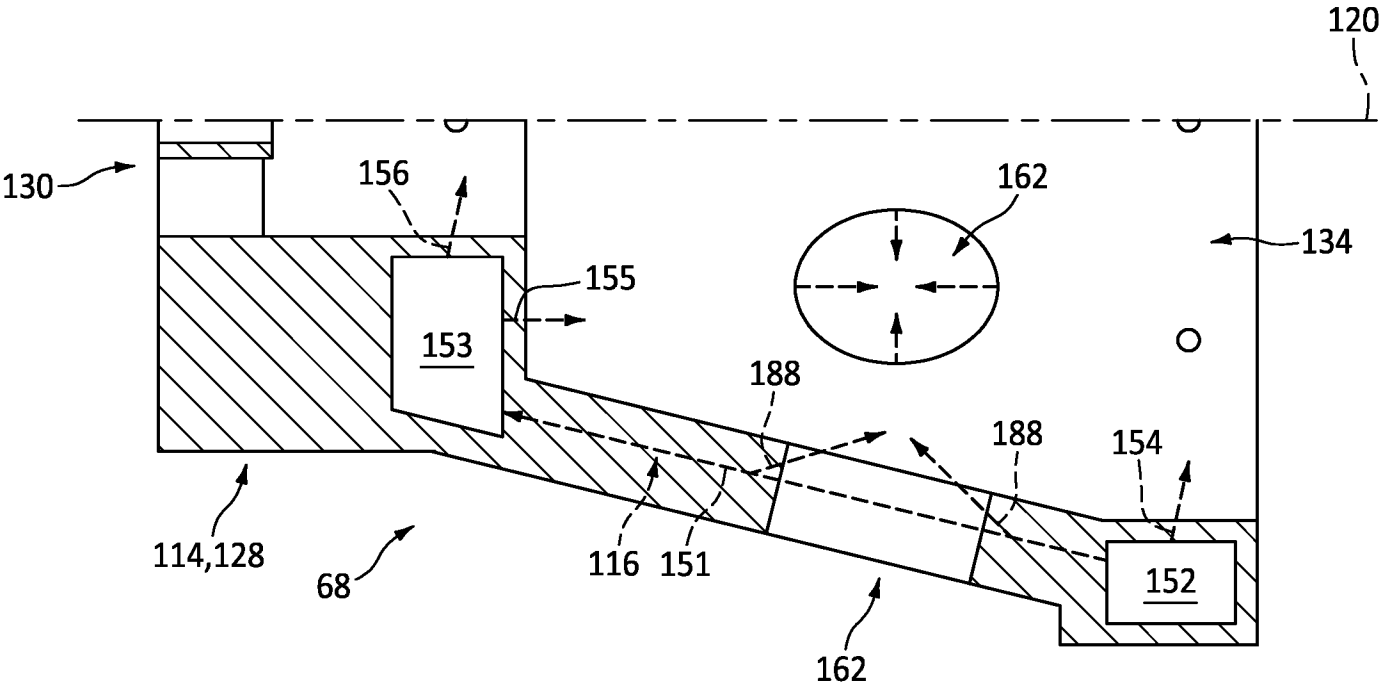
FIG. 9 is a partial sectional schematic illustration of the fuel-air mixer with additional fuel nozzle outlets.

Each fuel-air mixer 68 of FIG. 7 is described above with an arrangement of the fuel nozzle outlets 154-156. The present disclosure, however, is not limited to such an exemplary arrangement. For example, in some embodiments, any one or two types of the fuel nozzle outlets 154, 155, 156 may be omitted from one or more or all of the fuel-air mixers 68. In addition or alternatively, one or more or all of the fuel-air mixers 68 may each include one or more additional types of the fuel nozzle outlets. For example, referring to FIG. 9, one or more or all of the quench apertures 162 may be configured with one or more fuel nozzle outlets 188. With such an arrangement, the quench air is mixed with additional fuel.

The fuel-air mixers 68 may be included in various turbine engines other than the one described above. The fuel-air mixers 68, for example, may be included in a geared turbine engine where a geartrain connects one or more shafts to one or more rotors in a fan section, a compressor section and/or any other engine section. Alternatively, the fuel-air mixers 68 may be included in a turbine engine configured without a geartrain; e.g., a direct drive turbine engine. The fuel-air mixers 68 may be included in a geared or non-geared turbine engine configured with a single spool, with two spools (e.g., see FIG. 1), or with more than two spools. The turbine engine may be configured as a turbofan engine, a turbojet engine, a turboprop engine, a turboshaft engine, a propfan engine, a pusher fan engine or any other type of turbine engine. The turbine engine may alternatively be configured as an auxiliary power unit (APU) or an industrial gas turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:

a combustor comprising a bulkhead;

a fuel-air mixer including an inner passage, a sidewall and a fuel circuit, the inner passage extending axially along an axis within the fuel-air mixer, the sidewall extending circumferentially around and axially along the inner passage, the fuel circuit including a first fuel passage and a first fuel nozzle outlet fluidly coupled with the first fuel passage, the first fuel passage embedded within the sidewall and extending along the inner passage, and the fuel circuit configured to direct fuel into the inner passage through the first fuel nozzle outlet; and a mixer guide coupling the fuel-air mixer to the bulkhead, the mixer guide configured to slide axially along the fuel-air mixer such that the mixer guide and the fuel-air mixer slide relative to one another during operation of the turbine engine; and wherein the inner passage includes an upstream passage segment and a downstream passage segment that meets the upstream passage segment at an intersection, the downstream passage segment downstream of the upstream passage segment with respect to a fluid flow through the inner passage;

the upstream passage segment has a first lateral width at the intersection;

the downstream passage segment has a second lateral width at the intersection that is larger than the first lateral width; and the downstream passage segment radially expands outward away from the axis while extending axially along the axis away from the upstream passage segment.

2. The assembly of claim 1, wherein the mixer guide is configured to radially move relative to the bulkhead.

3. The assembly of claim 1, wherein the first fuel passage extends at least one of circumferentially about the inner passage within the sidewall; or axially along the inner passage within the sidewall.

4. The assembly of claim 1, wherein the fuel-air mixer extends axially along the axis to an end of the fuel-air mixer; and the first fuel nozzle outlet is arranged at the end of the fuel-air mixer.

5. The assembly of claim 4, wherein the first fuel passage is upstream of the first fuel nozzle outlet with respect to a flow of fuel through the fuel circuit.

6. The assembly of claim 4, wherein the first fuel passage is downstream of the first fuel nozzle outlet with respect to a flow of fuel through the fuel circuit.

7. The assembly of claim 1, wherein the fuel circuit further includes a second fuel passage;

the second fuel passage is embedded within the sidewall;

the second fuel passage extends axially along the first fuel passage; and the second fuel passage is fluidly between the first fuel passage and the first fuel nozzle outlet with respect to a flow of fuel through the fuel circuit.

8. The assembly of claim 7, wherein the second fuel passage is circumferentially aligned with the first fuel passage about the axis.

9. The assembly of claim 7, wherein the first fuel passage is disposed radially outboard of the second fuel passage within the sidewall.

10. The assembly of claim 1, wherein the first fuel nozzle outlet is arranged at the intersection.

11. The assembly of claim 10, wherein the fuel circuit is configured to direct the fuel into the upstream passage segment through the first fuel nozzle outlet.

12. The assembly of claim 10, wherein the fuel circuit is configured to direct the fuel into the downstream passage segment through the first fuel nozzle outlet.

13. The assembly of claim 1, wherein the fuel-air mixer further includes an air swirler; and the air swirler is configured to direct swirled air into the inner passage for mixing with the fuel.

14. The assembly of claim 13, wherein the fuel-air mixer extends axially along the axis between an upstream end and a downstream end; and the air swirler is arranged at the upstream end.

15. The assembly of claim 1, wherein the fuel-air mixer further includes a plurality of quench apertures arranged in an array about the axis; and each of the plurality of quench apertures extends radially through the sidewall to the inner passage.

16. The assembly of claim 1, further comprising:

a vane structure at a downstream end of the combustor;

the vane structure comprising a stator vane and a vane fuel circuit; and the vane fuel circuit including a second fuel passage, and the second fuel passage extending within the stator vane and fluidly upstream of the first fuel passage.

17. The assembly of claim 1, further comprising a hydrogen fuel source upstream of and configured to provide the fuel to the fuel circuit, wherein the fuel comprises hydrogen fuel.

18. An assembly for a turbine engine, comprising:

a fuel-air mixer including an inner passage, a sidewall and a mixer fuel circuit, the inner passage extending axially along an axis within the fuel-air mixer, the sidewall extending circumferentially around and axially along the inner passage, the mixer fuel circuit including a mixer fuel passage and a first fuel nozzle outlet fluidly coupled with the mixer fuel passage, the mixer fuel passage embedded within the sidewall and extending along the inner passage, and the mixer fuel circuit configured to direct fuel into the inner passage through the first fuel nozzle outlet; and a vane structure comprising a stator vane and a vane fuel circuit, the vane fuel circuit including a second fuel passage, the second fuel passage extending within the stator vane, and the second fuel passage fluidly upstream of the mixer fuel circuit with respect to a flow of fuel, wherein:

the inner passage includes an upstream passage segment and a downstream passage segment, the downstream passage segment downstream of the upstream passage segment with respect to a fluid flow through the inner passage; and the downstream passage segment radially expands outward away from the axis while extending axially along the axis away from the upstream passage segment.

19. An apparatus for a turbine engine, comprising:

a fuel-air mixer including an inner passage, a sidewall, a fuel circuit and an air swirler;

the inner passage extending axially along an axis within the fuel-air mixer;

the sidewall extending circumferentially around and axially along the inner passage;

the fuel circuit including a first fuel passage and a first fuel nozzle outlet fluidly coupled with the first fuel passage, the first fuel passage embedded within the sidewall and extending along the inner passage, and the fuel circuit configured to direct fuel into the inner passage through the first fuel nozzle outlet; and the air swirler arranged at an upstream end of the fuel-air mixer, and the air swirler configured to direct swirled air into the inner passage for mixing with the fuel within the inner passage, wherein:

the inner passage includes an upstream passage segment and a downstream passage segment, the downstream passage segment downstream of the upstream passage segment with respect to a fluid flow through the inner passage; and the downstream passage segment radially expands outward away from the axis while extending axially along the axis away from the upstream passage segment.

* * * * *